US005391096A

United States Patent [19]

Chiron et al.

[11] Patent Number: 5,391,096

[45] Date of Patent: Feb. 21, 1995

[54] DEVICE FOR SELECTIVELY INTERCONNECTING A SERIES OF CONDUCTORS

[75] Inventors: Bertrand Chiron, Coulaines; Jean Raoelison, Le Mans; Patrick Leger, Mulsanne, all of France

[73] Assignee: Framatome Connectors International, Paris, France

[21] Appl. No.: 81,963

[22] Filed: Jun. 24, 1993

[30] Foreign Application Priority Data

Jun. 26, 1992 [FR] France ..... 92 07913

[51] Int. Cl.[6] ..... H01R 11/09

[52] U.S. Cl. ..... 439/724; 439/188

[58] Field of Search ..... 439/709–717, 439/721, 722, 723, 724, 725, 696, 188, 733

[56] References Cited

U.S. PATENT DOCUMENTS

| | | | |
|---|---|---|---|
| 3,471,822 | 10/1969 | Baelen | 439/724 |
| 3,725,852 | 4/1973 | Blanchet | 439/724 |
| 3,835,442 | 9/1974 | Anderson et al. | 439/723 |
| 3,877,772 | 4/1975 | De Cenzo | 439/724 |
| 4,015,889 | 4/1977 | Blanchet | 439/723 |
| 4,580,863 | 4/1986 | Lohr et al. | 439/724 |
| 4,653,842 | 3/1987 | Kirma | 439/723 |

FOREIGN PATENT DOCUMENTS

| | | | |
|---|---|---|---|
| 0214627 | 3/1987 | European Pat. Off. . | |
| 0471602A1 | 2/1992 | European Pat. Off. | H01R 31/08 |
| 2035672 | 12/1970 | France . | |
| 2578361 | 9/1986 | France . | |
| 9207913 | 4/1993 | France . | |
| 2007014 | 9/1970 | Germany . | |

*Primary Examiner*—Larry I. Schwartz
*Assistant Examiner*—Hien D. Vu
*Attorney, Agent, or Firm*—Perman & Green

[57] ABSTRACT

A device for selectively interconnecting a series of conductors comprises an insulative housing provided with a series of parallel passages through it each adapted to receive a conductive pin whose free end forms the male connection member and whose opposite end is connected to one of the conductors. The various pins all emerge at their free end on a common side of the housing. An insulative cover closes this side of the housing and is provided internally with a plurality of U-shape cross-section conductive bars forming female connection members each facing a plurality of the passages and adapted to cooperate with a plurality of pins by coming into contact with the emergent free ends thereof so as to short-circuit them electrically together. The housing comprises in each passage retaining members in one piece with the housing and cooperating with a shoulder on the pin after insertion thereof into the housing so as to oppose axial loads exerted on the pins by the conductors and so retain the pin axially in its passage and maintain the end of the pin between the branches of the U-shape of the bar. The cover and the bar are substantially devoid of arrangements for axial mechanical retention of the pins.

9 Claims, 3 Drawing Sheets

DEVICE FOR SELECTIVELY INTERCONNECTING A SERIES OF CONDUCTORS

BACKGROUND OF THE INVENTION

1. Field of the Invention

The invention concerns a device for selectively interconnecting a series of correctors.

2. Description of the Prior Art

These devices are used in fields including aeronautical engineering where onboard electric circuits are made by joining together rows of pins each connected to one of the conductors am short-circuited to each other by means of "shunt bars" whereby all the conductors in contact with the same bar are, at the same potential.

In more detail, a device of this kind comprises:

an insulative housing provided with a series of parallel passages through it each adapted to receive a conductive pin whose free end forms the male connection member and whose opposite end is connected to one of said conductors, the various pins all emerging at their free end on a common side of the housing, and an insulative cover closing said side provided internally with a plurality of U-shape cross-section conductive bars forming female connection members each facing a plurality of said passages and adapted to cooperate with a plurality of pins by coming into contact with the emergent free ends thereof so as to short-circuit them electrically together.

There are usually a large number of housings; they are of modular design and can be juxtaposed by mounting them on a common rail, for example. Their modularity (i.e. the possibility of modifying the interconnection arrangements with a reduced number of parts) is an important element in the design of these devices, as are their weight (a critical parameter in aeronautics) and their cost (given the very large numbers in which they are used).

FR-A-2 578 361 and EP-A-0 214 627 describe modular interconnect devices of this kind and disclose numerous embodiments.

However, the devices described in these documents always use relatively complex shape parts, especially in regard to the conductive bars, and do not enable extensive miniaturization, with the result that they cannot be applied to interconnecting very small pins very closely packed in a common housing.

The invention stems from the observation that these drawbacks (complex bar shapes, impossibility of extensive miniaturization) arise principally from the fact that the conductive bars have a two-fold function, namely making electric contact with the pins and mechanical retention of the pins in the device: this two-fold function implies a more complex shape and therefore one that is more costly to manufacture and more difficult to miniaturize.

It is often desirable to short-circuit the pins not only within one row but also between two parallel adjacent rows. As described in the aforementioned EP-A-0 214 627, for example, the bars may be a double U-shape rather than a single U-shape. As appropriate, either the double U-shape is used to short-circuit the pins of two adjacent rows or the double U-shape is divided into two single U-shapes used independently to short-circuit the pins in a single row. This presupposes that the bars are manufactured in the double U-shape form, which is more complex and therefore more costly, and implies a stage of dividing these double bars, which further complicates the manufacture and preparation of these devices.

It is also known from patent application EUP-A-471 602 for the housing to include in each passage retaining members in one piece with the housing and cooperating with a shoulder on the pin after the latter is inserted in its passage so as to oppose axial loads exerted on the pins by the conductors and so retain the pin axially in its passage and maintain the end of the pin by the bar. It further includes a spring type interconnect member which does not allow cooperation with adjoining members.

An object of the invention is to propose a simple, inexpensive and general purpose interconnect structure.

SUMMARY OF THE INVENTION

The invention consists in a device for selectively interconnecting a series of conductors comprising:

an insulative housing provided with a series of parallel passages through it each adapted to receive a conductive pin whose free end forms the male connection member and whose opposite end is connected to one of said conductors, the various pins all emerging at their free end on a common side of the housing, and an insulative cover closing said side provided internally with at least one interconnect member forming female connection members each facing a plurality of said passages and adapted to cooperate with a plurality of pins by coming into contact with the emergent free ends thereof so as to short-circuit them electrically together, wherein said housing comprises in each passage retaining members in one piece with said housing and cooperating with a shoulder on said pin after insertion thereof into said passage so to oppose axial loads exerted on said pins by said conductors and so retain said pin axially in its passage and maintain the end of said pin by said interconnect member, said cover having U-shape passages, said interconnect members being U-shape bars and said cover and said bars being substantially devoid of means for axial mechanical retention of the pins.

Thus by separating the electric contact function (provided by the bars, which have no other function) and the mechanical pin retention function (implemented by the retaining members which are in one piece with the housing) the structure and therefore the manufacture of the bars is considerably simplified, so that the cost can be reduced and they can be substantially miniaturized.

The retaining members are advantageously elastic lugs molded into the housing and projecting axially towards the pin shoulder. This embodiment provides retaining members as part of the molding operation, with no further operation of machining or inserting separate parts such as the "locking sleeves" proposed in the prior art.

Each branch of the U-shape of the bar is preferably sub-divided into a plurality of contiguous tongues including tongues directed towards the interior of the U-shape forming said female connection members cooperating with the free end of the pins; this plurality of tongues advantageously further comprises tongues directed towards the outside of the U-shape which may among other things form members for mechanical retention of the bar in a compartment in the cover, these tongues cooperating with the walls of the compartment when the bar is force-fitted into the compartment.

This configuration further alleviates the aforementioned drawback encountered when it is required to short-circuit two adjacent parallel rows of pins. All that is required is for the walls separating adjacent compartments of the cover to have two different heights, as appropriate, selected so that the lower height walls enable electrical contact between the outwardly directed tongues of respective adjacent bars and so short-circuit together all of the pins in contact with the bars and so that the greater height walls are inserted between the outwardly directed tongues of respective adjacent bars and so insulate the two series of pins in contact with the bars.

Accordingly, the bars are all exactly the same and manufactured as a single U-shape (which significantly rationalizes manufacture, the tooling being commensurately simpler) and it is the operation of molding the cover (large or small height of wall) which determines whether two adjacent rows are short-circuited together or not, rather than the type of bar used (single U-shape or double U-shape) as in the prior art. Furthermore, this feature makes it a very simple matter to short-circuit together three, four or even more rows, without any upper limit, whereas in the cited prior art multiple interconnections are limited to two adjacent rows because of the impossibility (for reasons of symmetry) of manufacturing triple or quadruple U-shapes.

The height of the outwardly directed tongues is preferably such that when the bar is inserted fully into the compartment the tongues are flush with the surface of the cover so as to enter into contact with the homologous surface of the housing.

One embodiment of the invention will now be described with reference to the appended drawings in which the same reference numbers denote similar items.

DETAILED DESCRIPTION OF THE INVENTION

Figure 1:
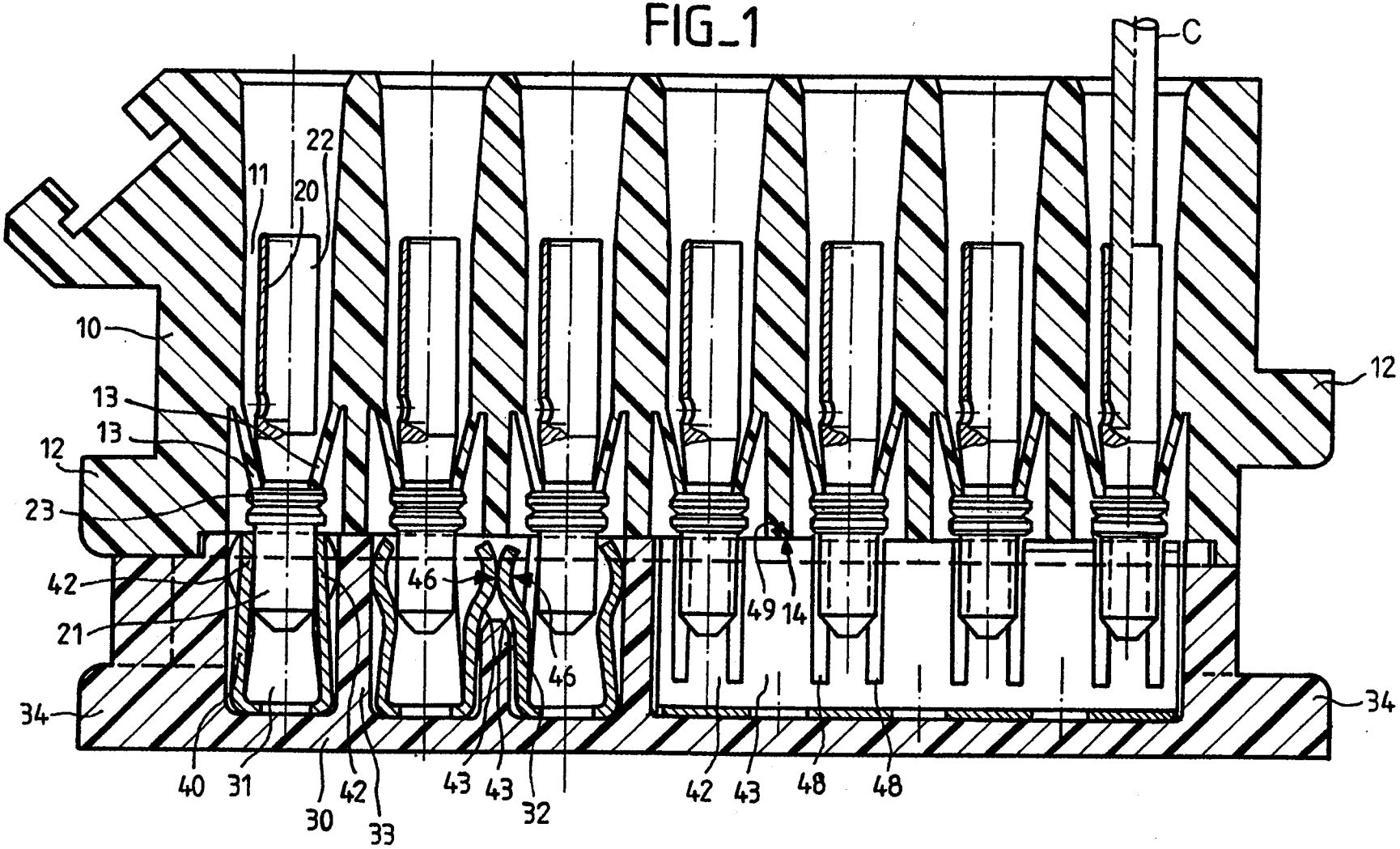
FIG. 1 is a cross-section view in elevation of an interconnection device in accordance with the invention fitted with its pins and its shunt bars.

Referring to the figures, an insulative material housing 10 has a series of passages 11 through it each receiving a conductive pin 20. A free end 21 of each pin emerges from the housing and the opposite end 22 is connected to one of the conductors C (only one of which is shown) to be interconnected in a particular arrangement. The other essential component of the device is an insulative material cover 30 which has compartments 31 in a particular configuration depending on the required connection arrangement and each receiving a generally U-shape cross-section conductive bar 40. The cover fitted beforehand with its bars is fitted and fixed to the housing in a sealed manner, for example by ultrasonic welding.

Because of the flat shape of the cover and the housing, it is possible to juxtapose a very large number of these interconnect devices in a common cabinet, for example by mounting them on a common rail trapping the shoulders 12 of the housing and 34 of the cover.

When the device is subsequently wired, by inserting into the passages the various pins each crimped to its respective conductor, the free ends 21 of the various pins are inserted between the branches of the U-shape of the bar facing them so as to make electrical contact and to short-circuit all the pins in contact with the same bar.

In a manner that is characteristic of the invention, each of the passages 11 comprises elastic lugs 13 molded into it, for example four lugs at 90°. These lugs project from the interior wall of the passage in the axial direction and towards the side of the body to which the cover is applied (downwards in FIG. 1). It is therefore a simple matter to insert the pin joined to its conductor from above (as seen in FIG. 1); the shape and the elasticity of the lugs enabling unimpeded movement of the pin in this direction.

On the other hand, after the pins are fitted traction may be applied to the conductors and result in an axial force on the pins in the direction opposite to the insertion direction (upwards in FIG. 1); in this case each lug 13 abuts against a shoulder 23 of the pin and is braced against the latter, preventing extraction of the pin from the body and so holding the free end 21 between the two branches of the U-shape of the bar 40.

Figure 3:
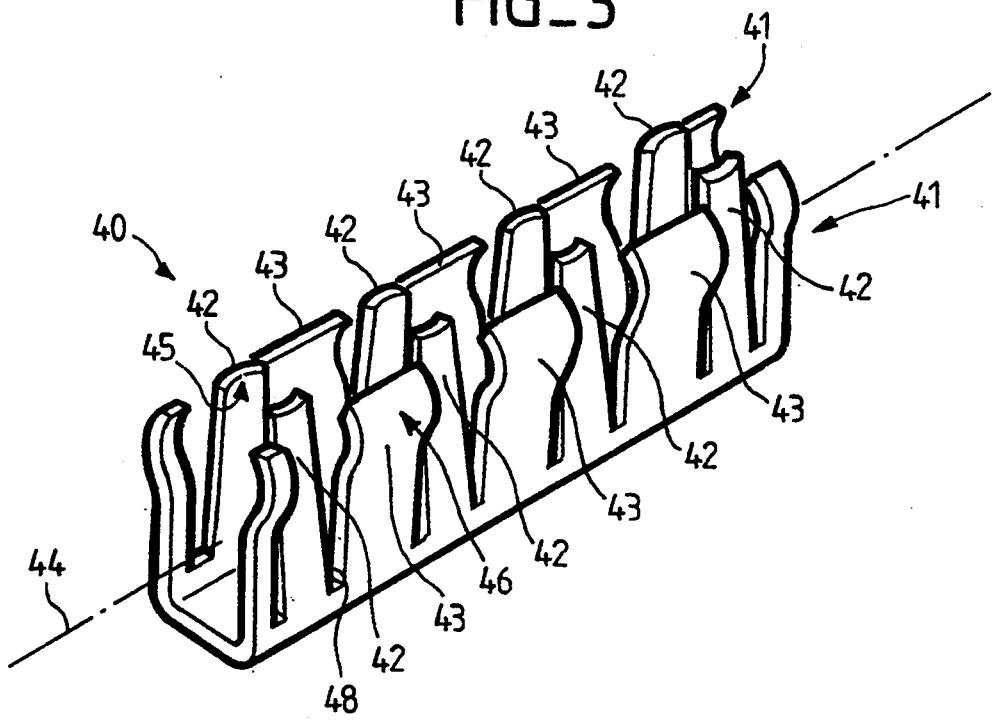
FIGS. 3 and 4 are respectively a perspective and a plan view of one of the shunt bars used in the device from FIGS. 1 and 2.
Figure 4:
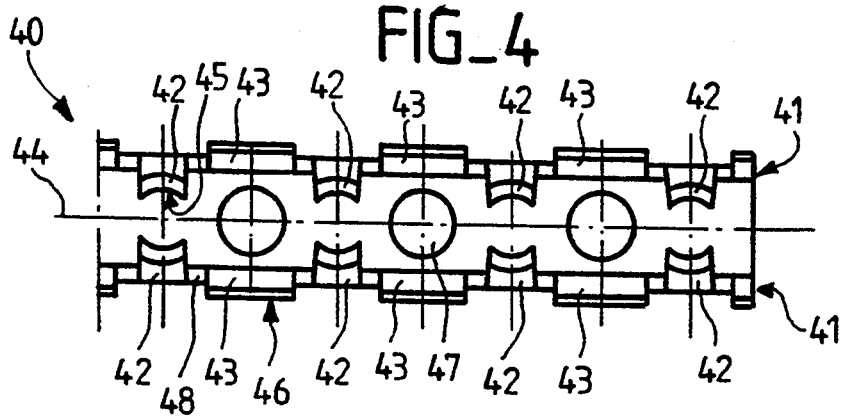

The configuration of the bar will now be described in more detail with reference to FIGS. 3 and 4.

On each of the branches 41 of the U-shape a series of alternating tongues 42, 43 is formed. The narrower tongues 42 are bent towards the inside of the U-shape (i.e. towards the axis 44 of the bar) and provide the electrical contact by cooperation with the free end of the pin (as shown for the pin at the extreme lefthand side in FIG. 1). For improved contact, the end of the tongues 42 is preferably slightly concave in the transverse direction in order to mate better with the rounded shape of the pin. The wider tongues 43 are curved outwardly, i.e. away from the axis 44. Their function is to mechanically retain the bars 40, after they are fitted into the compartments 31 of the cover 30, by bearing against the side walls of the compartments.

The height of the tongues 43 (i.e. their dimension in the direction perpendicular to the axis 44) is advantageously chosen so that when the bar is inserted fully into its compartment 31 the tongues 23 are flush with the surface of the cover (at 49 in FIG. 1) so as to come into contact with the homologous surface of the housing (at 14 in FIG. 1): consequently, fitting and welding the cover to the housing immobilizes the bars once and for all, the bars being trapped between the bottom of the compartment and the surface of the housing, without any specific locking member or relief shape being needed.

Figure 2:
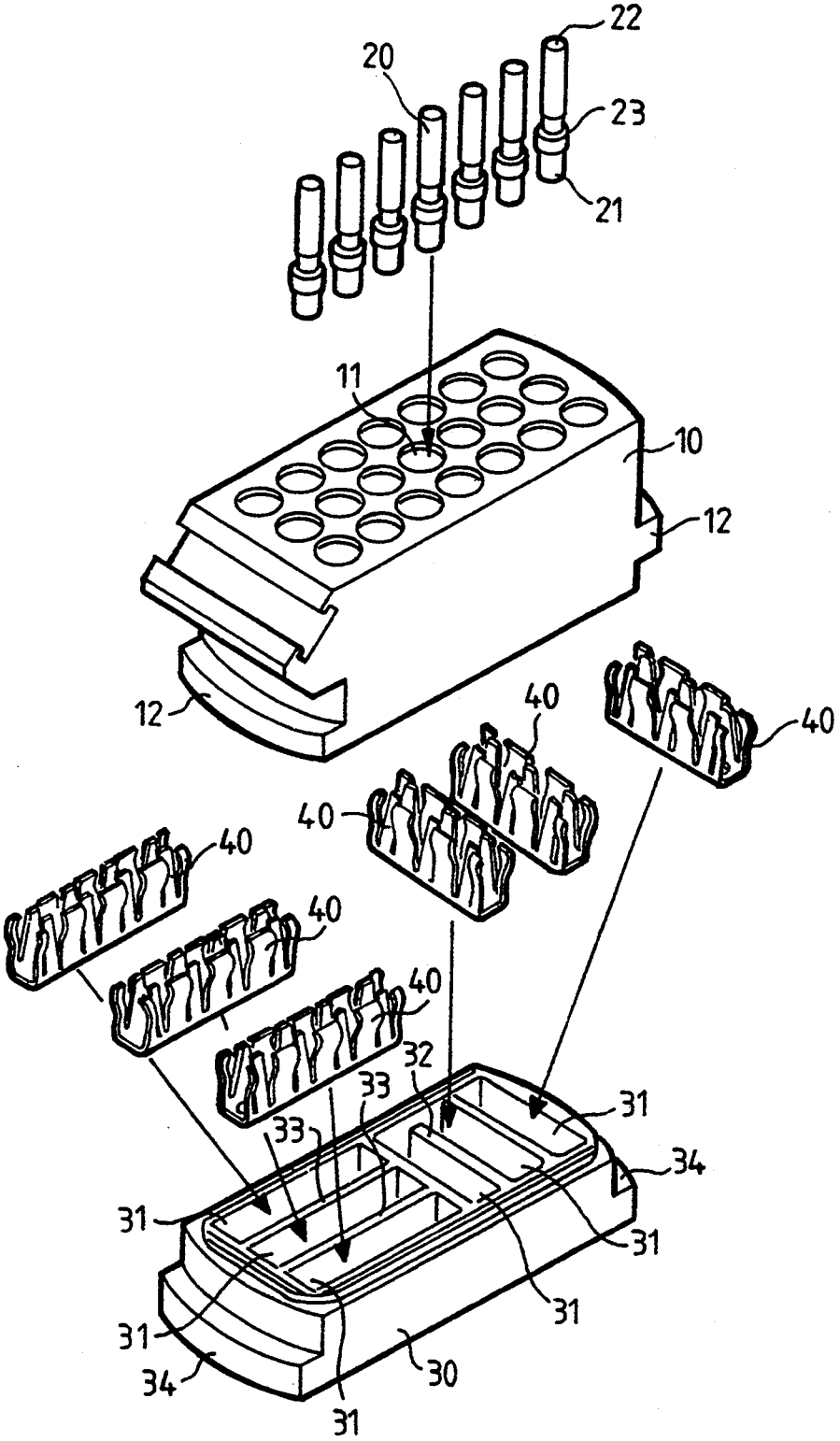
FIG. 2 is an exploded perspective view of the device from FIG. 1 showing how the various components are assembled.

The tongues 43 can have an ancillary function, namely, establishing electric contact between two adjacent bars. If the covers are molded so that some of the partitions (the partitions 32 in FIGS. 1 and 2) separating the compartments 31 are of reduced height, the tongues 43 of adjacent bars enter into contact with each other, as shown in the case of the second and third bars from the left in FIG. 1. The tounges 43 are able to contact each other because they are outwardly curved. If higher partitions are molded (partitions 33 in FIGS. 1 and 2), however, these higher partitions are inserted between the tongues 43 of adjacent bars and prevent any electrical contact between the adjacent bars, as in the case of the first and second bars from the left in FIG. 1. For improved contact, the tongues 43 are slightly convex in the outward sense and in the axial direction, as shown at 46 in FIGS. 1 and 3.

A bar in accordance with the invention offers numerous advantages from the functional point of view despite its extremely simple structure.

It may be fabricated from a continuous stripform blank from which feed holes 47 are punched followed by notches 48 defining the various tongues, which stages are followed by bending of the branches of the U-shape and, finally, curving of the various tongues 42 and 43 to their final shape. There is only one design of bar regardless of the type of interconnection required and the bars are then cropped from the blank in lengths matching the compartments 31 formed in the cover. The interconnection arrangement depends only on the molding of the cover, the arrangement being defined by the configuration of the various compartments 31, defining the rows of pins that will be interconnected, and the height of the walls 32 and 33, defining any interconnection between two adjacent parallel rows of pins. The bars do not require any adaptation except for cropping to the length of the compartment appropriate to the interconnection arrangement.

There is claimed:

1. Device for selectively interconnecting a series of conductors comprising:

an insulative housing provided with a series of parallel passages through it each adapted to receive a conductive pin whose free end forms a male connection member and whose opposite end is connected to one of said conductors, the pins all emerging at their free end on a common side of said housing, and an insulative cover closing said common side provided internally with at least one interconnect member forming female connection members each facing a plurality of said passages and adapted to cooperate with a plurality of said pins by coming into contact with the free ends thereof so as to short-circuit them electrically together, wherein said housing comprises, in each passage, retaining members in one piece with said housing and cooperating with a shoulder on said pin, after insertion thereof into said passage, so as to oppose movement of the pins out of the housing by axial loads exerted on said pins by said conductor and, so retain said pin axially in its passage and maintain the end of said pin, said cover having U-shape passages, said at least one interconnect member being a U-shaped bar and said cover and said bar being substantially devoid of means for axial mechanical retention of the pins.

2. Device according to claim 1 wherein said retaining members are elastic lugs molded into said housing and projecting axially and towards said shoulder on said pin.

3. Device according to claim 1 wherein each branch of the U-shape of said bar is subdivided into a plurality of contiguous tongues including first tongues directed towards the interior of the U-shape bar and forming said female connection members cooperating with the free end of said pins.

4. Device according to claim 3 wherein said plurality of contiguous tongues includes second tongues directed towards the outside of the U-shape bar.

5. Device according to claim 4 wherein said second tongues form means for mechanical retention of said bar in a compartment of said cover, said second tongues cooperating with the walls of said compartment upon force-fitting of said bar into said compartment.

6. Device according to claim 4 wherein adjacent compartments of said cover are separated by walls which have one of two different heights

7. Device according to claim 4 wherein the height of said outwardly directed tongues is such that when said bar is fully inserted into its compartment said tongues are flush with a surface of said cover so as to enter into contact with a homologous surface of said housing.

8. Device according to claim 6 wherein a greater height wall of the two different height walls is located between the second tongues of adjacent bars to insulate them from each other.

9. Device according to claim 6 wherein a lower height wall of the two different height walls forms an open area above the lower height walls to allow second tongues of adjacent bars to contact each other.

* * * * *